United States Patent [19]

Do

[11] Patent Number: 5,074,382

[45] Date of Patent: Dec. 24, 1991

[54] OFFSHORE ACCESS SYSTEMS

[75] Inventor: Christopher N. Do, Petaling, Australia

[73] Assignee: IEV International Pty. Limited, Malaysia

[21] Appl. No.: 444,124

[22] PCT Filed: Jun. 3, 1988

[86] PCT No.: PCT/AU88/00172

§ 371 Date: Nov. 30, 1989

§ 102(e) Date: Nov. 30, 1989

[87] PCT Pub. No.: WO88/09765

PCT Pub. Date: Dec. 15, 1988

[30] Foreign Application Priority Data

Jun. 3, 1987 [AU] Australia ..... PI2278

[51] Int. Cl.[5] ..... B66B 9/00

[52] U.S. Cl. ..... 187/1 R; 182/142; 114/312

[58] Field of Search ..... 187/1 R, 95, 20, 21; 182/141, 142, 145, 143, 150, 152, 195; 114/312

[56] References Cited

U.S. PATENT DOCUMENTS

| | | | |
|---|---|---|---|
| 3,908,794 | 9/1975 | Stone | 182/142 |
| 4,474,263 | 10/1984 | Christopher | 182/142 |
| 4,538,705 | 9/1985 | Leivestad | 182/142 |
| 4,650,036 | 3/1987 | Matsuda | 182/142 |

FOREIGN PATENT DOCUMENTS

| | | | |
|---|---|---|---|
| 877843 | 8/1971 | Canada | 182/142 |

*Primary Examiner*—H. Grant Skaggs
*Assistant Examiner*—Kenneth Noland
*Attorney, Agent, or Firm*—Banner, Birch, McKie & Beckett

[57] ABSTRACT

The present invention is directed to an offshore access system that includes a support frame designed to be supported by grating positioned above horizontal structural members of the offshore structure. A support sleeve is attached to the support frame. Within the support sleeve there is included a vertically slidable and rotatable post. A mobile works platform is attached to a lower end of the vertically slidable and rotatable post. The work platform has a U-shaped configuration in one embodiment to provide maximum access to vertical structural members.

6 Claims, 9 Drawing Sheets

OFFSHORE ACCESS SYSTEMS

TECHNICAL FIELD

This invention relates to offshore structures and more particularly to the inspection and maintenance operations necessary for the upkeep of such structures.

BACKGROUND ART

Inspection and maintenance operations are among the most important cost contributors to the ongoing operation expenditure of offshore structures. The costs involved in the performance of these operations may be itemised as follows: labour; access; materials; and equipment. Labour is conventionally required to set up scaffolding and to carry out associated rigging work where existing access is not provided. When an access problem is to be resolved in an environment in which work maybe heavily affected by weather conditions—for example, work performed under the sea deck of an offshore platform, on piles supporting wharves and jetties and the like—then costs associated with access work may well become the top cost contributor and, in some cases at least, affect both the work schedule and the estimated budget of a project.

Heretobefore, conventional demountable scaffolding has largely been employed as the primary means for providing access to offshore structures for the carrying-out of work at locations at which cranes and derricks cannot be employed. Scaffolding is, however, a time consuming and difficult task, requiring licensed scaffolders for the undertaking. For certain inspection procedures, scaffolding may well take up to as much as 95% of total working time.

DISCLOSURE OF INVENTION

It is an object of the present invention to overcome the above and other disadvantages by the provision of an access system designed to significantly reduce costs, and which can be rapidly and safely installed and recovered at minimum cost. Thus, to this end, the invention is directed to offshore access systems which are safe, portable, inexpensive, simple, durable and which have a long working life; moreover, the need for the employment of qualified riggers or scaffolders is eliminated or, at least, reduced to a minimum.

In accordance with the present invention, therefore, there is provided an offshore access system comprising a mobile work platform or landing adapted to be movable in relation to a structural member of an offshore structure, on which, or in connection with which, a task is to be performed, so as to enable access to be gained thereto; and means for so moving the said mobile work platform or landing.

BRIEF DESCRIPTION OF DRAWINGS

In order that the reader may gain a better understanding of the present invention, hereinafter will be described certain embodiments thereof, by way of example only and with reference to the accompanying drawings in which.

BEST MODES FOR CARRYING OUT THE INVENTION

Figure 1:
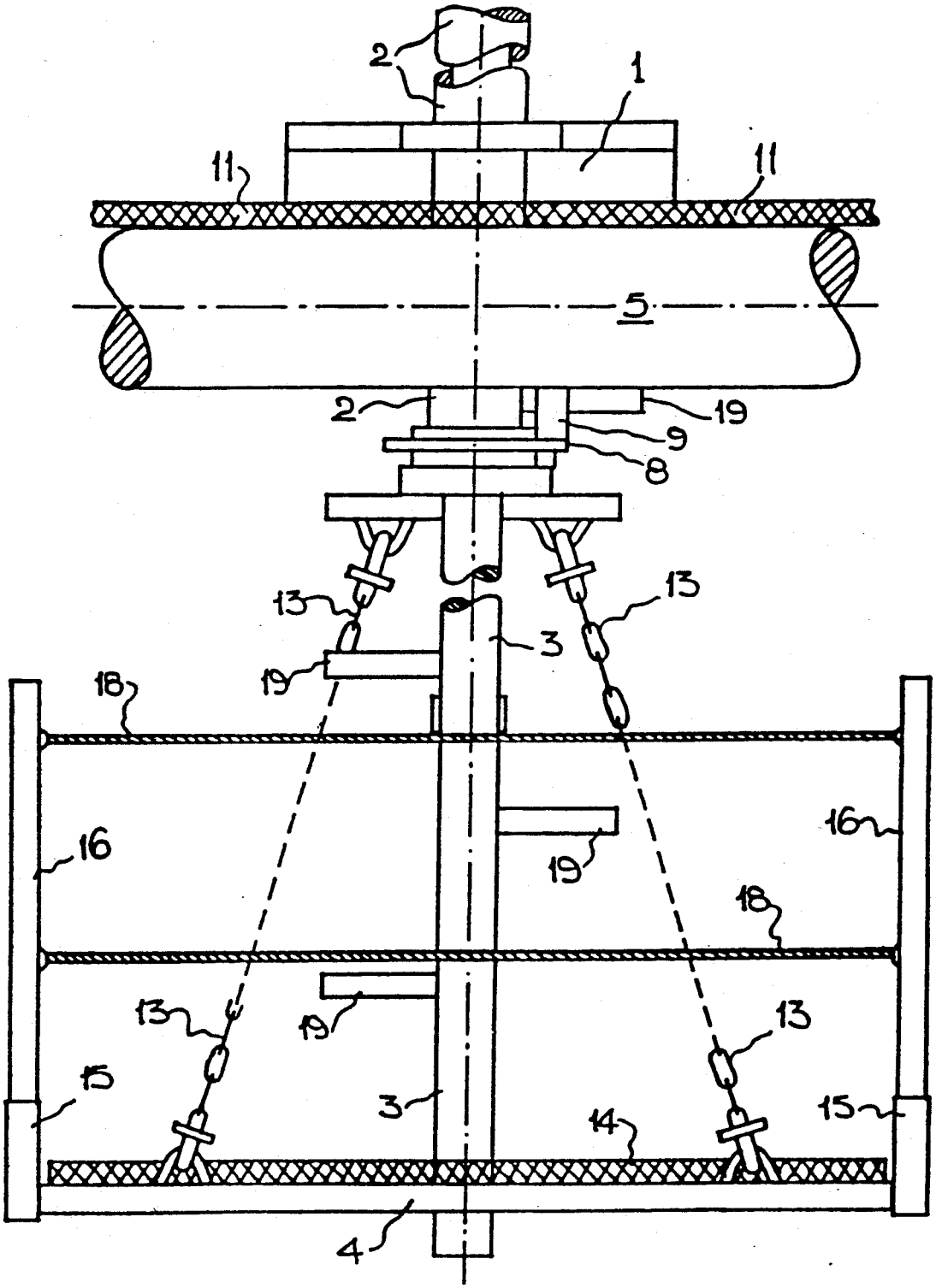
FIG. 1 is a front elevation of an offshore access system in accordance with the present invention.
Figure 2:
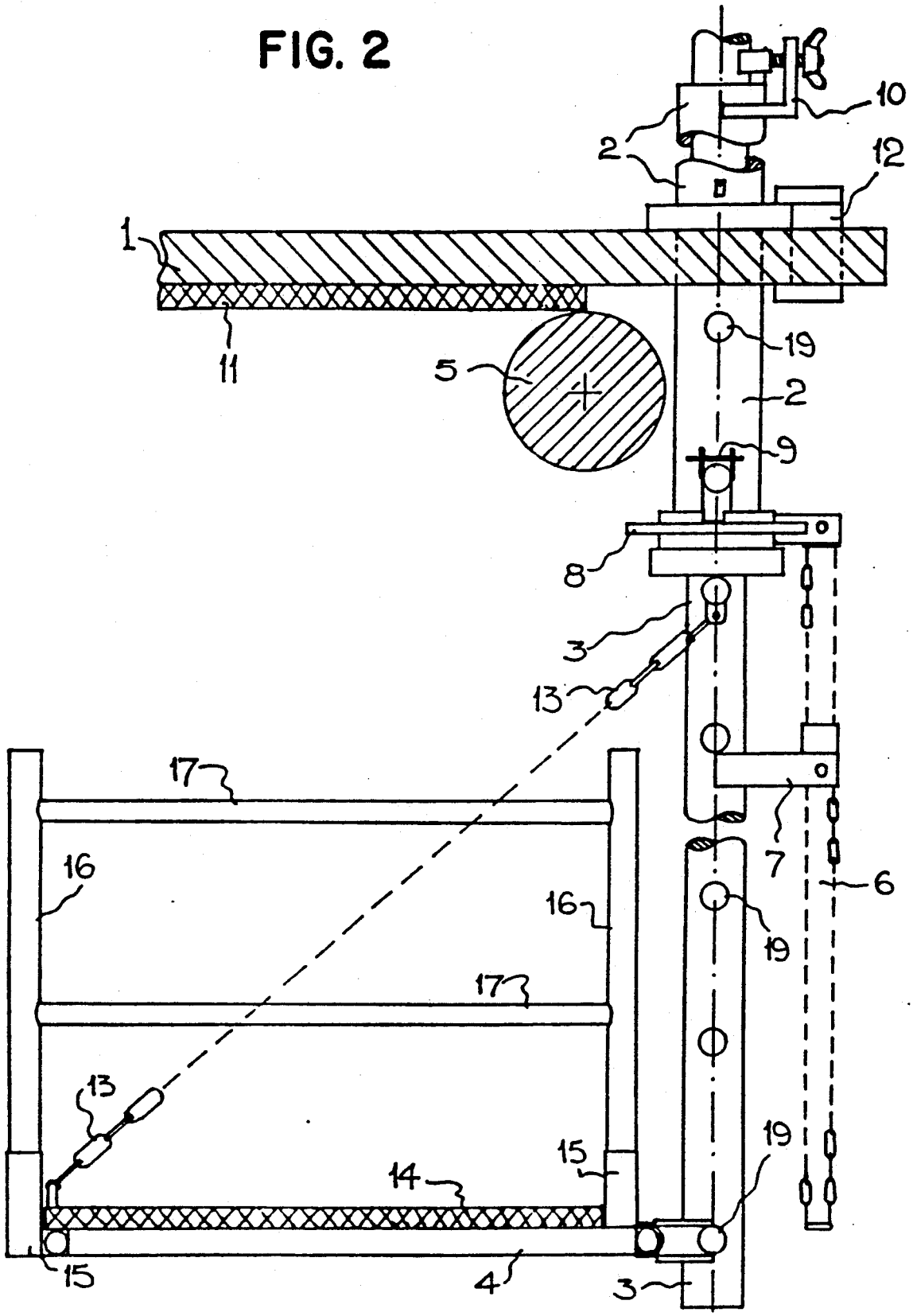
FIG. 2 is a corresponding side elevation.

FIGS. 1 and 2 illustrate, respectively, front and side elevational views of a first embodiment of a offshore access system according to the present invention, which embodiment includes a support frame 1, a support sleeve 2, a vertically slidable post 3 and a mobile work platform or landing 4.

Slidable post 3 slides within support sleeve 2 to enable access to be had to areas underneath the deck of an offshore structure at varying heights. Control of the vertical disposition of slidable post 3 relative to support sleeve 2 is obtained by the actuation of a manually-operated wire rope winch 6 which connects, at 7, post 3 to a freely rotatable disc 8 which surrounds support sleeve 2.

Slidable post 3 is also able to rotate within support sleeve 2 to provide access at different angular positions in a plane normal to the longitudinal axis of post 3. This rotation can be fixed, while the vertical position of landing 4 is being adjusted, by a rotation-locking device 9.

Figure 3:
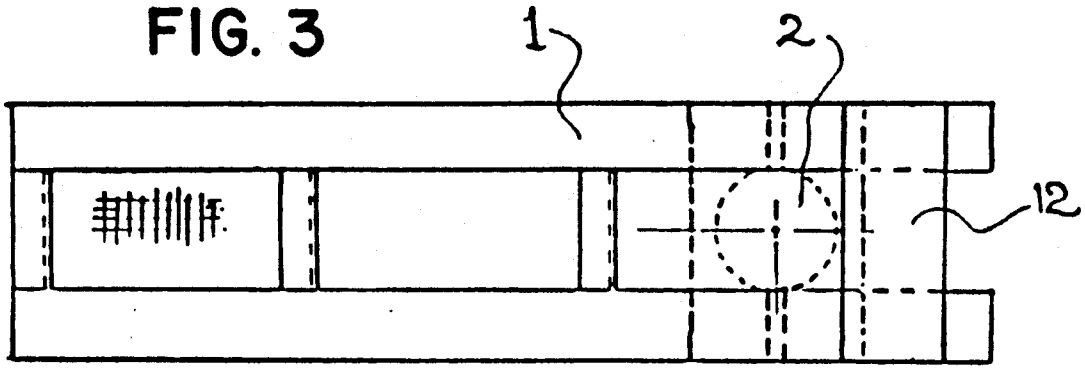
FIG. 3 is a plan view of an inventive support frame.
Figure 4:
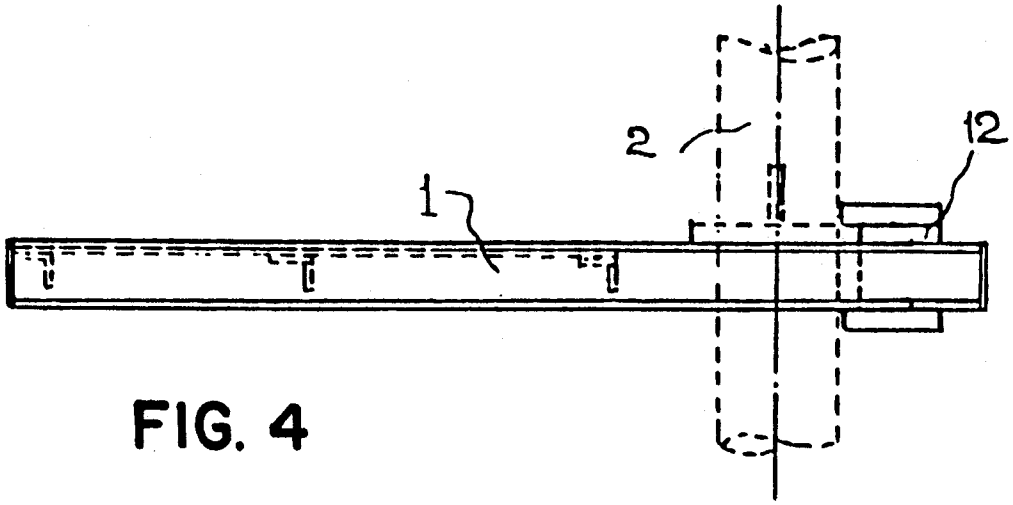
FIG. 4 is a corresponding side elevation.

FIGS. 3 and 4 illustrate the support frame 1 in somewhat greater detail. Support frame 1 fits over support sleeve 2 and is itself supported upon grating 11 and structural member 5 of a seadeck; sleeve locking means 12 prevent the system from overturning under load. Tie-down beams and chains secure support frame 1 to the deck members.

Landing 4 is substantially suspended from the lower part of slidable post 3 by a pair of ropes or chains 13; when the system is not is use, landing 4 is folded and secured to post 3. The landing 4 is itself a substantially rectangular framework overlaid by a grating 14 of wood and is provided with sockets 15 in which removable handrail posts 16 are able to be fitted. Ideally, side-rails 17 together with a pair of the posts 16 constitute a handrail unit, the two units being connected by chains or ropes 18. In a variation, landing 4 may be constructed in a substantially "U" shape to enable it to be deployed around vertical structural members thus offering maximum access space for a given landing surface area.

Rungs 19 are welded to both support sleeve 2 and the lower part of post 3 to permit access to landing 4.

Installation of the inventive offshore access system preferably follows the following sequence:

(a) the support frame is secured to the seadeck of the offshore rig by tie-down beams, chains and bolts;

(b) the slidable post is inserted into the support sleeve until the least distance is achieved;

(c) the wire rope winch is installed;

(d) the post and sleeve are slid inwards on the support frame track until the sleeve contacts the nearest seadeck member;

(e) the locking mechanisms are installed actuated to ensure no further movement of the sleeve can take place once an operator commences descent;

(f) the landing is rotated to a desired angular position;

(g) the landing is unfolded and the rotation-locking device actuated;

(h) the operator steps onto the landing and commences lowering the slidable post, using the winch, until the required position is reached; and (i) the safety handrails and ropes are installed before the operator commences work.

This first access platform embodiment is able to accommodate various structural configuration ranging from an outboard side of a deck, a walkway, to a "K" or "T" joint, etc., provided that the structure on which the device is installed is accessible.

The system is highly flexible as it allows for both rotational and vertical movement of the landing. Moreover, installation and recovery of the device can be carried out within a relatively short span of time without employing qualified or skilled personnel, due to its simplicity. Problems relating to the dismantling and re-erection of scaffolding as a result of foreseen heavy seas and adverse weather conditions are thus completely eliminated. The risk of losing scaffolding material, when there is insufficient time to dismantle it, is also avoided.

Figure 5:
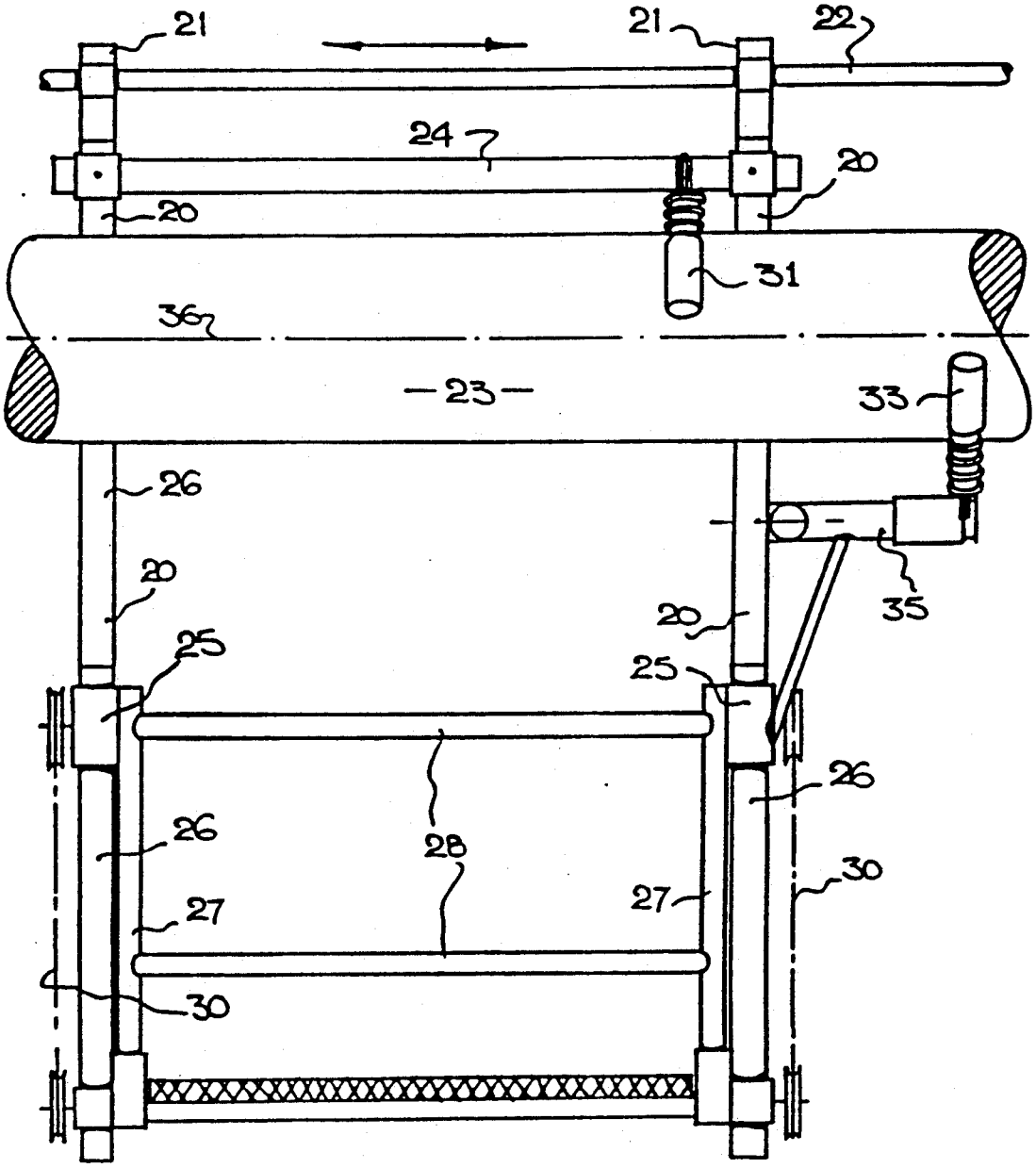
FIG. 5 is a front elevation of a second embodiment of the invention.
Figure 6:
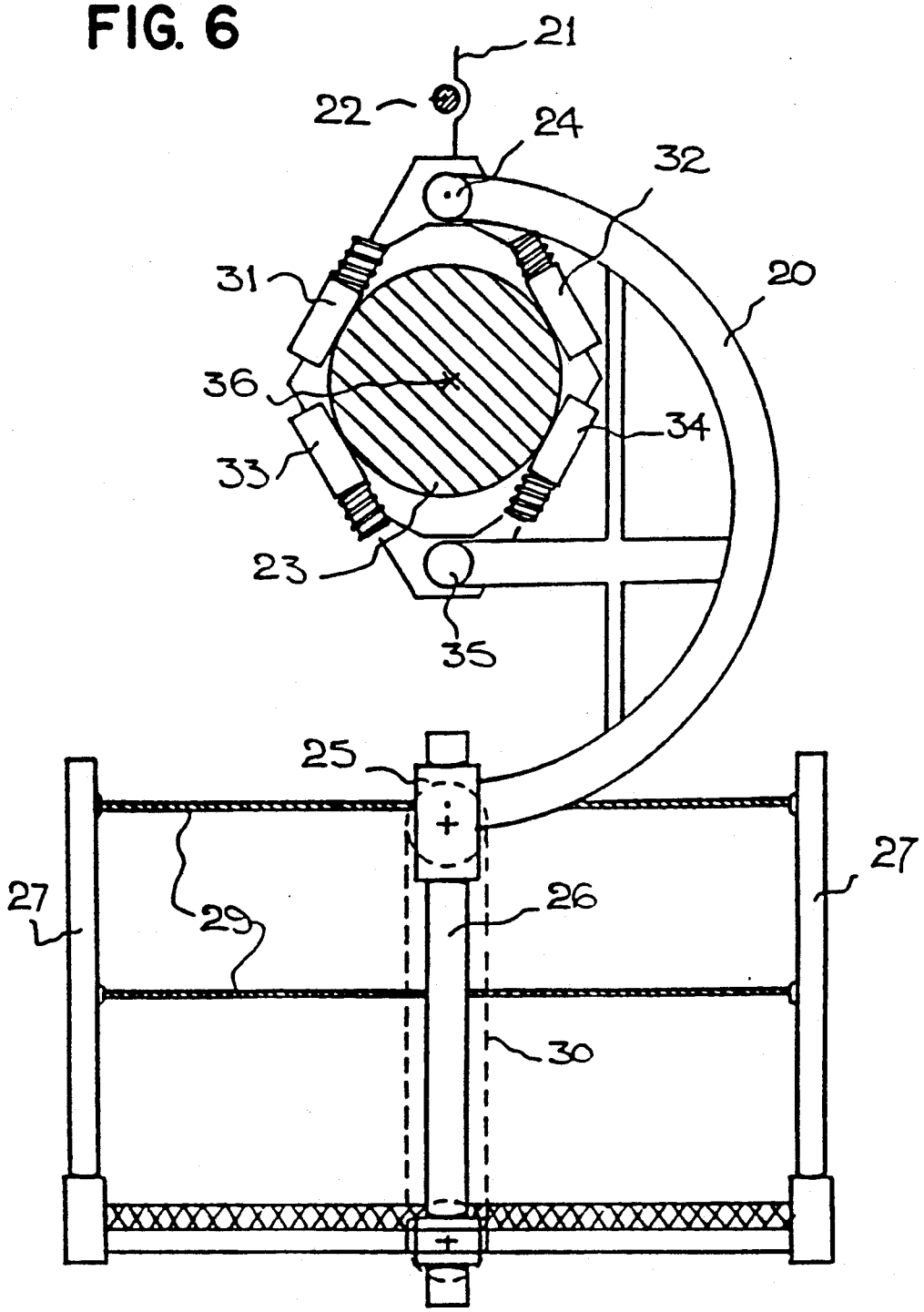
FIG. 6 and 6A is a corresponding side elevation.

Turning now to FIGS. 5 and 6, these show a further embodiment of the invention, for application in situations where access is required over a length of a structural member in a horizontal plane. This mobile work platform or landing includes a spaced-apart pair of davit-like, semi-circular support arms 20, each upper end of which carries a bracket 21 which is adapted to be rigidly clamped onto a horizontal driving cable 22 disposed above a horizontal structural member; in FIGS. 5 and 6, this member on which, or at least, in connection with which, a task—such as maintenance for example—is required to be performed is referenced 23. The upper ends of each arm are further connected by a mounting bar 24 and, on each lower end of each support arm 20 is a support sleeve 25.

Disposed beneath the horizontal structural member 23 is the landing proper, at each lateral side of which is a post 26 which is able to slide within its associated support sleeve 25. As these posts are attached to the landing, the latter will be caused to be raised and lowered as posts 26 slide upwardly and downwardly, respectively, through the support sleeves 25. As in the previously—described embodiment, the landing is provided with corner posts 27 and siderails 28 and 29.

The means for raising and lowering the slidable posts 26, and attached landing, in relation to the structural member 23, is a conventional manually-operable wire rope winch, represented at 30, at each lateral side of the landing.

To enable the inventive mobile work platform or landing to move smoothly along horizontal structural member 23, mounting bar 24 carries a spaced-apart, angled pair of rollers 31, 32 adapted to engage the upper part of member 23, while a second angled pair of similar rollers 33, 34 mounted on semi-circular support arm 20. Rollers 33 and 34 are carried on an outrigger arm 35 which is pivoted or hinged so as to enable the rollers to be swung out of contact with the member 23; this is to allow the work platform to be removed to another location as required.

Rotation of support arms 20 about mounting bar 24 is permissible during installation but the arms must be immobilised by any suitable means during working operation. Satisfactory positioning of the landing platform below structural member 23 is, of course, greatly facilitated by the former's centre of gravity being directly below the longitudinal axis 36 of structural member 23.

Figure 6A:
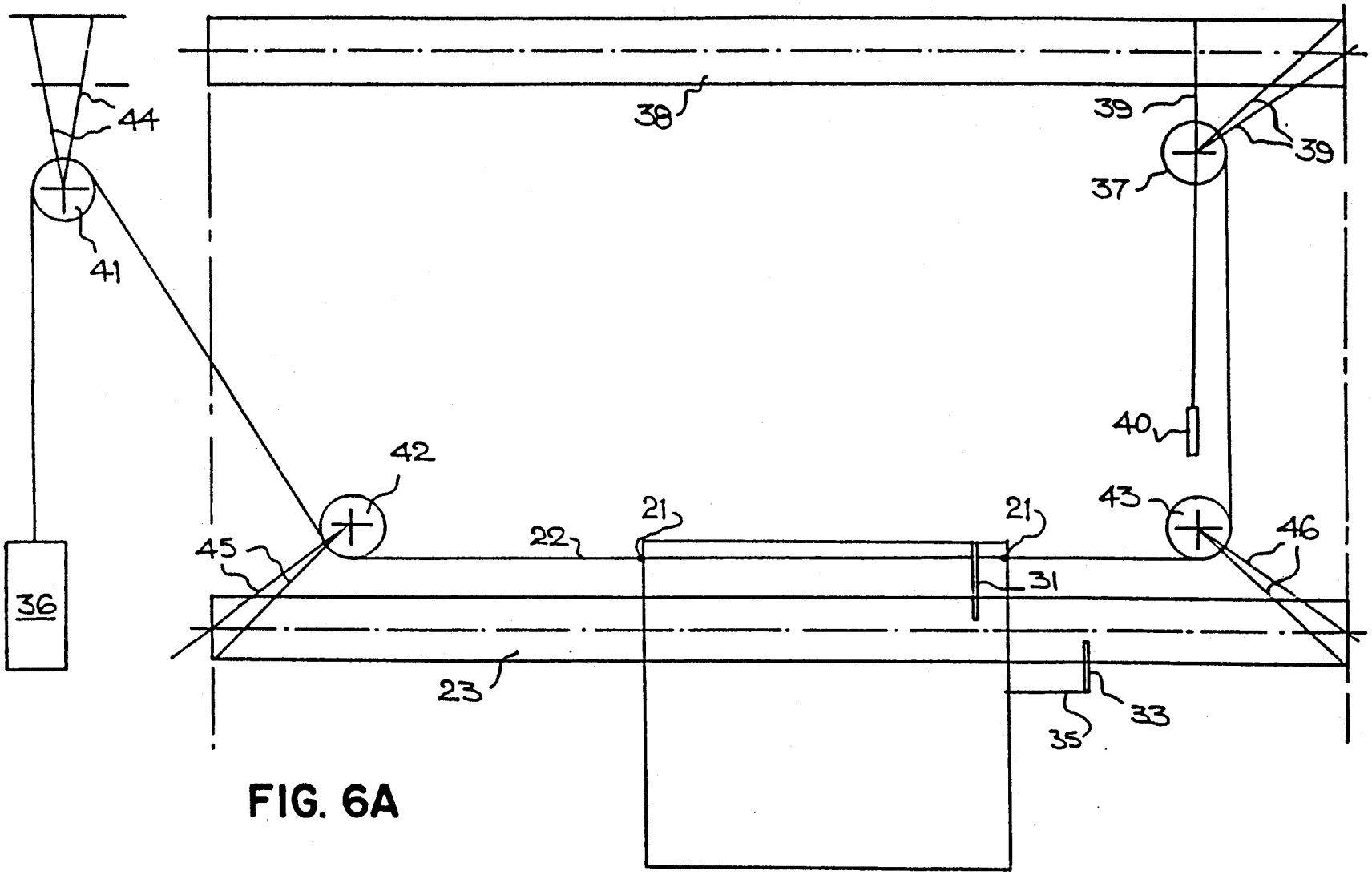

The means to move the work platform or landing in a horizontal direction, over the length of the horizontal structural member 23 is a conventional, gravity-tensioning pulley system, schematically illustrated in FIG. 6A. The driving cable 22 extends between a gravity tensioning mass 36 and an air-operated wire rope winch 37 suspended from an upper horizontal structural member 38 by suspension chains or cables 39. Winch 37 has a pendant hand control unit 40, operation of which actuates winch 37 to cause driving cable 22 to move between pulleys 41, 42 and 43, so moving along with it the clamped-on work platform or landing as described with reference to FIGS. 5 and 6. Of these three pulleys, pulley 41 is suspended from member 38 by suspension chains or cables 44, pulley 42 is attached to lower member 23 by tie-down chains or cables 45, while pulley 43 is attached to lower member 23 by tie-down chains or cables 46. An alternative, and simpler method of moving the work platform along the horizontal structural member is by the use of lever hoists at two ends of the driving cable 22.

Installation of this second embodiment of the inventive offshore access system may follow the following sequence:

(i) the driving cable is firstly installed and tensioned;

(ii) the brackets are secured to the driving cable;

(iii) the mounting bar and support arms are connected to the brackets;

(iv) the landing is installed and the winches operated so as to bring to its closest position relative to the arms;

(v) the landing and the arms are rotated about the mounting bar to a normal operating position and immobilising means are inserted to lock the rotation of the arms;

(vi) access to the work platform is by way of the fixed platform described above or via a purpose-built ladder suspended from the seadeck;

(vii) the landing is dropped and the handrails and their ropes or chains are fitted into the sockets;

(viii) the operator may now step onto the landing to operate the winches in order to obtain the desired or required working height.

Control of the horizontal path of travel of the landing along the driving cable 22 can be governed by operators working on the landing, through the depending control console 40 or by the giving of verbal or signalled instructions to an operator, stationed on the seadeck, responsible for looking after the drive cable control means.

Figure 7:
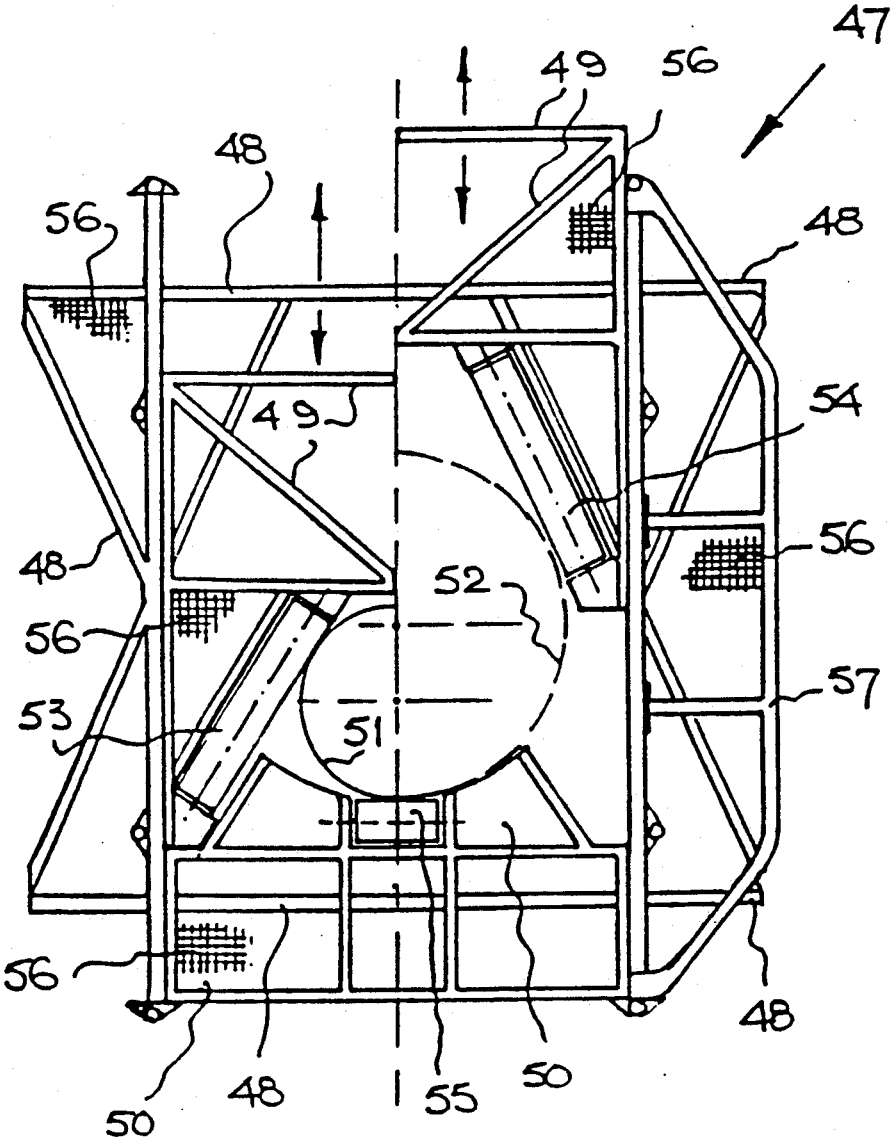
FIG. 7 is a plan view of another embodiment of the invention, being a mobile work platform or landing for vertical and diagonal structural members.
Figure 8:
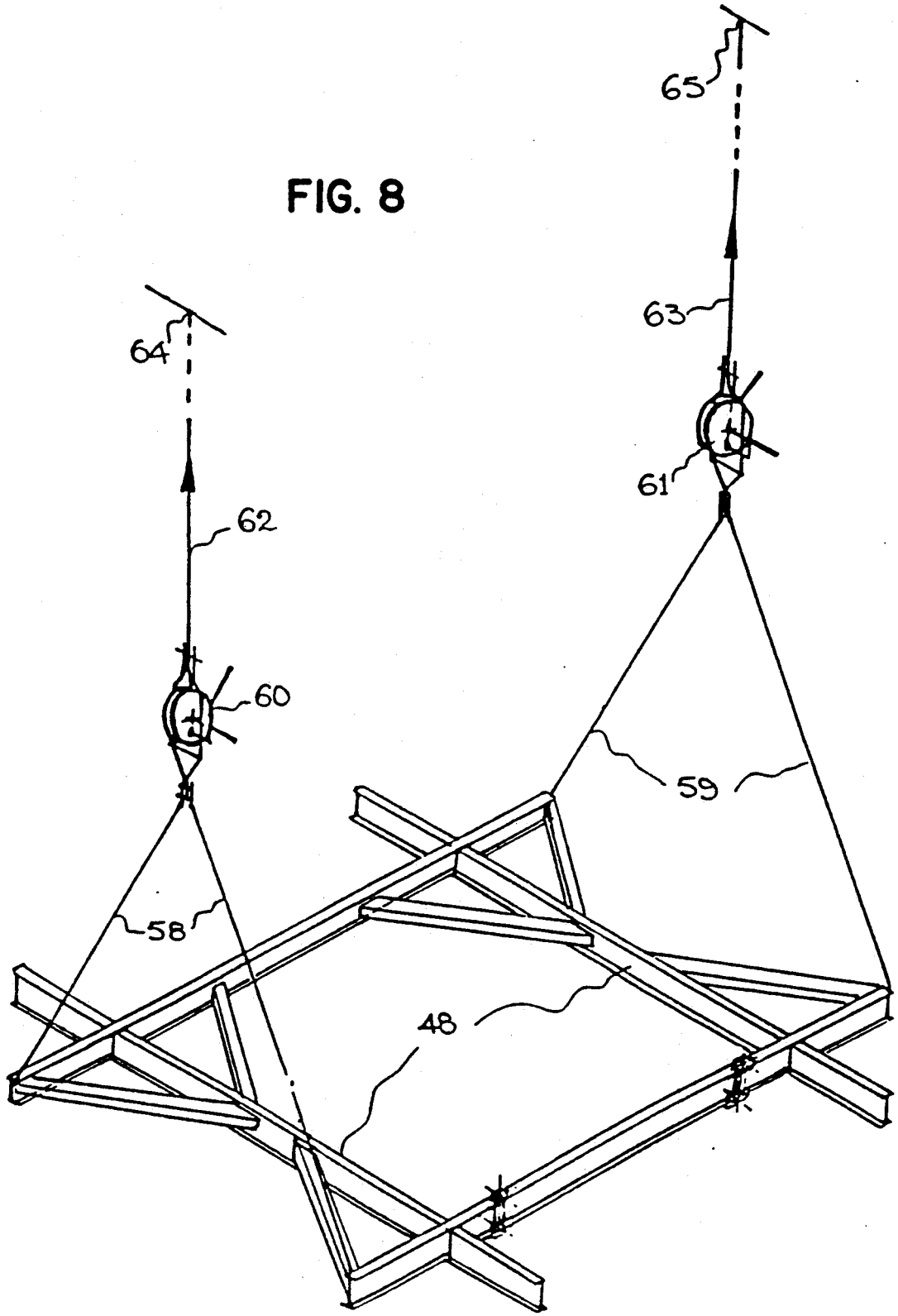
FIG. 8 is an isometric view of the main frame of the landing of FIG. 7.
Figure 9:
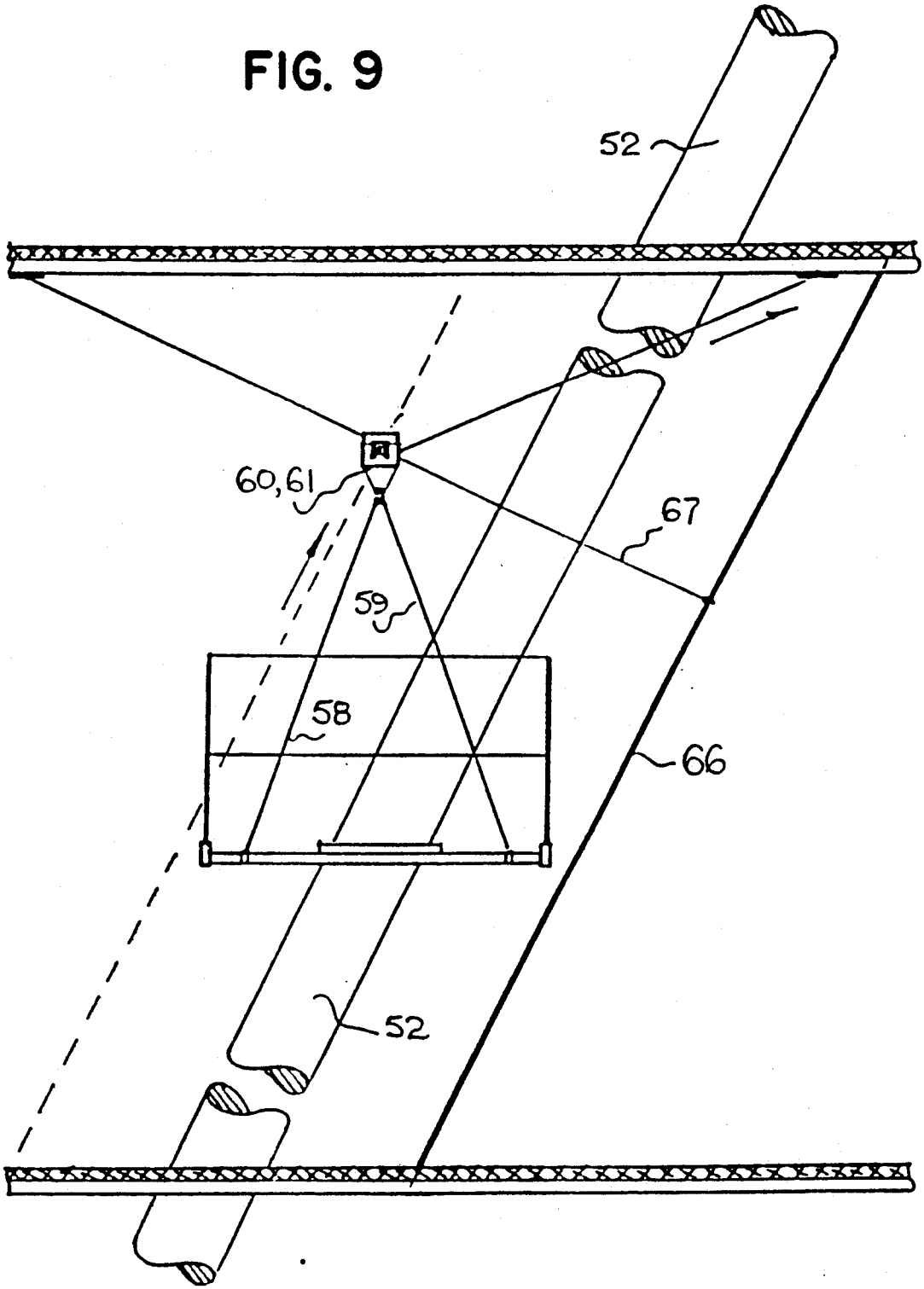
FIG. 9 shows, schematically, the side elevation of the landing of FIGS. 7 and 8, in situ on a diagonal structural member.

The readers attention is now drawn to FIGS. 7, 8 and 9 which illustrate yet a further embodiment of the present invention.

This embodiment eliminates the need for building massive scaffolding towers to provide access to legs, conductors and other members for the carrying out of maintenance tasks on offshore structures. The embodiment incorporates the following desirable factors:

(a) safety;

(b) ease of installation and transportation;

(c) stability;

(d) light weight;

(e) low cost;

(f) capabilities to accommodate various objects, dimensions and structural configurations.

In this embodiment, the mobile work platform or landing 47 includes a main frame 48 arranged to surround a vertical structural member, to which main frame 48 is attached an inner sliding frame 49 and a gate element 50. Main frame 48 in particular, is made up from structural "I"—beams, best to be seen in FIG. 8, which may be disassembled for ease of transportation, to provide rigidity to and support for the overlying platform. Tracks or the like are provided to permit horizontal travel—as indicated by arrows "A"—of inner sliding frame 49 when its position is to be adjusted, relative to main frame 48, so as to be able to install the platform around vertical members of differing diameters, as indicated at 51 and 52.

Replaceable rollers 53, 54 are mounted on diagonal members of sliding frame 49 and constitute two sides of a notional triangle, these two rollers being adapted to engage a part of the periphery of the vertical member as shown in FIG. 7. A third replaceable roller 55 is mounted on gate element 50 and constitutes the remaining side of the notional triangle, to thus be able to encompass member 51 or 52. Gate element 50 is movable—as by, say, being hinged or pivoted to main frame 48—so as to function as an access door or flap able to be opened and closed during installation and recovery of the mobile work platform or landing.

A metal grating or slatted wooden member 56 is laid on top of main frame 48, sliding frame 49 and gate element 50, as well as over one or more outrigger frames, as that referenced 57, which can be additionally provided to extend the working area of the platform or landing when the application is to vertical structural members.

The lifting mechanism for lowering and raising the work platform or landing includes a pair of triangulated cables or rigid bars 58, 59 attached to opposed sides of main frame 48, a manually-operable winch 60, 61 attached to the apex of each triangulated cable and, extending upwardly from each winch 60, 61, a respective winch cable 62, 63, these winch cables being secured to anchor points 64, 65 located at an offshore structure's upper deck adjacent a vertical structural member to which access is required.

Referring lastly to FIG. 9, in the case of diagonal travel, a down wire or cable 66 tensioned between two decks and disposed parallel to the longitudinal axis of the diagonally-oriented structural member, is provided to act as a guide to the direction of travel of the working platform; the winches 60, 61 are now replaced by two pulleys slidably tethered to down cable 66 by connecting cables, as that referenced 67. Two air-operated winches anchored from the upper deck are used as alternative operative means.

The positions of the winches and the fixed ends of the hoisting cables should be selected so as to offer the least driving force capable of lifting the platform, and the maximum stability.

INDUSTRIAL APPLICABILITY

Although the embodiments described herein above are primarily intended as an access maintenance system for offshore structures such as oil rigs, it will be appreciated that the same principles can be applied to access systems for other structures where scaffolding is required to provide access to the structure, either on land or in a marine environment, e.g., bridge superstructures and under bridge or overpass roadways.

The access systems of the present invention can be fabricated or manufactured from any suitable materials which maintain the structural integrity of the system—e.g., aluminium, fibreglass, timber, etc.

From the abovegoing, it will be readily appreciated by those skilled in the art that numerous variations and modifications may be made to the invention without departing from the spirit and scope thereof as set out in the following claims.

What is claimed is:

1. An offshore access system comprising a support frame adapted to be supported upon a grating disposed above a horizontal structural member of an offshore structure on which, or in connection with which, a task is to be performed; a support sleeve affixed to said support frame and extending therethrough; a vertically slidable post able to slide within said support sleeve and being able to rotate with respect thereto; a mobile work platform or landing suspended from a lower part of said vertically slidable post, said platform or landing having a substantially U-shaped configuration so as to enable it to be deployed around a vertical structural member of said offshore structure, thereby providing maximum access space for a given landing surface area; and a lifting mechanism for raising and lowering said vertically slidable post and suspended mobile work platform or landing to enable access to be gained to the said vertical structural member.

2. The offshore access system as claimed in claim 1, wherein said mobile work platform or landing is adapted to be folded and secured to said vertically slidable post when not in use.

3. The offshore access system as claimed in claim 1 or claim 2, wherein said lifting mechanism is a manually-operable wire rope winch.

4. The offshore access system as claimed in claim 1 or claim 2, wherein said support sleeve and said lower part of the said vertically slidable post are provided with rungs to facilitate access to said mobile work platform or landing.

5. The offshore access system as claimed in claim 1 or claim 2, wherein locking means are provided on said support sleeve to prevent unwanted rotational movement of said vertically slidable post therein.

6. An offshore access system comprising a support frame adapted to be supported upon a grating disposed above a horizontal structural member of an offshore structure on which, or in connection with which, a task is to be performed; a support sleeve affixed to said support frame and extending therethrough; a vertically slidable post able to slide within said support sleeve and being able to rotate with respect thereto; a mobile work platform or landing suspended from a lower part of said vertically slidable post, said platform or landing having a substantially U-shaped configuration so as to enable it to be deployed around a vertical structural member of said offshore structure, thereby providing maximum access space for a given landing surface area; said support sleeve and said lower part of said vertically slidable post being provided with rungs to facilitate access to said mobile work platform or landing; and a lifting mechanism for raising and lowering said vertically slidable post and suspended mobile work platform or landing to enable access to be gained to the said vertical structural member.

* * * * *